US008191332B1

(12) United States Patent
Semaan et al.

(10) Patent No.: US 8,191,332 B1
(45) Date of Patent: Jun. 5, 2012

(54) REINFORCEMENT SYSTEM FOR POLES

(75) Inventors: Robert I. Semaan, Omaha, NE (US); Roger I. Semaan, Omaha, NE (US)

(73) Assignee: American Tower Corporation, Boston, MA (US)

( * ) Notice: Subject to any disclaimer, the term of this patent is extended or adjusted under 35 U.S.C. 154(b) by 1087 days.

(21) Appl. No.: 11/233,976

(22) Filed: Sep. 24, 2005

Related U.S. Application Data

(60) Provisional application No. 60/612,994, filed on Sep. 25, 2004.

(51) Int. Cl.
*E04B 1/00* (2006.01)

(52) U.S. Cl. ..... 52/745.17; 52/170; 52/295; 52/834; 52/848; 174/45 R

(58) Field of Classification Search ..... 52/292, 52/295, 296, 223.14, 223.4, 223.5, 170, 40, 52/514, 745.17, 741.1, 745.21, 736.4, 736.2, 52/736.3, 726.4, 723.1, 737.4, 737.5, 738.1, 52/736.1, 731.4, 721.4, 721.5, 723.2, 737.1, 52/146, 149, 151, 834–836, 843, 848, 849; 343/875, 890, 891, 892; 174/45 R
See application file for complete search history.

(56) References Cited

U.S. PATENT DOCUMENTS 904,952 A * 11/1908 Hacket ..... 174/45 R
2,841,634 A * 7/1958 Kimball ..... 52/632
6,453,636 B1 * 9/2002 Ritz ..... 52/736.4
6,513,299 B1 2/2003 Damiano ..... 52/657.02
6,694,698 B2 * 2/2004 Ryan ..... 52/741.1
6,901,717 B2 * 6/2005 Brunozzi et al. ..... 52/723.1
6,915,618 B2 * 7/2005 Payne ..... 52/736.1
7,253,786 B1 * 8/2007 Logozzo ..... 343/890
2002/0140621 A1 * 10/2002 Harrison ..... 343/890
2002/0140623 A1 * 10/2002 Harrison ..... 343/898
2002/0170261 A1 * 11/2002 Brunozzi et al. ..... 52/721.4
2002/0194794 A1 * 12/2002 Hill et al. ..... 52/40
2003/0010426 A1 * 1/2003 Lockwood ..... 156/187
2003/0026923 A1 * 2/2003 Al-Zoubi et al. ..... 428/34.1
2003/0205021 A1 * 11/2003 Ryan ..... 52/736.1
2004/0020158 A1 * 2/2004 Kopshever, Sr. ..... 52/723.2
2004/0134161 A1 * 7/2004 Lockwood et al. ..... 52/736.1
2004/0148903 A1 * 8/2004 Cash ..... 52/720.1
2004/0194402 A1 * 10/2004 Payne ..... 52/170

* cited by examiner

*Primary Examiner* — William Gilbert
(74) *Attorney, Agent, or Firm* — BrainwoodHuang

(57) ABSTRACT

A reinforcement system made of steel members, (e.g., steel reinforcing rods, threaded rods or functionally equivalent steel members), closely positioned with respect to, or positioned in contact with, the exterior of straight, tapered, and/or pipe/stepped poles, such as wireless telecommunication poles. The method of use results in providing additional strength to the poles to enhance resistance against deflection caused by, for instance, wind forces and/or added weight resulting from mounting antennas thereto, enabling the placement of, for instance, more antenna arrays and other communication antennas thereon than is otherwise possible.

20 Claims, 6 Drawing Sheets

REINFORCEMENT SYSTEM FOR POLES

This Application Claims Benefit of Provisional Application Ser. No. 60/612,994, Filed Sep. 25, 2004.

TECHNICAL FIELD

The present invention is directed towards systems and method of reinforcing poles, and more particularly a reinforcement system comprising steel members (e.g., steel reinforcing rods, steel plates, threaded rods or functionally equivalent members), closely positioned with respect to, or positioned in contact with, the exterior of:

straight, tapered and/or pipe/stepped poles, such as wireless telecommunication poles. The method of use results in providing additional strength to said poles to enhance resistance against deflection caused by, for instance, wind forces and/or added weight resulting from mounting antennas thereto, thereby enabling the placement of, for instance, more antenna arrays and other communication antennas thereon than would otherwise be possible.

BACKGROUND

It is known to use free-standing monopoles to, for instance, support power transmission lines and to support antennas, (e.g., cell sites), such as required for cellular telephone. Particularly as regards the latter, even though demand for improved cellular telephone service continues to grow, local zoning laws are becoming increasingly prohibitive as regards new construction. As a result, wireless companies are placing additional antennas on existing towers. While this approach avoids zoning problems, it creates-leads to loading existing monopoles beyond their design capacity.

Various inventors have noted the problem and proposed systems to increase the loading capacity of existing monopoles. For instance, published applications of Harrison, Nos. 2002/0140621 and 2002/20140623 A1, describe the addition of strengthening elements to the exterior surface of a monopole, and suggests that base plate and/or foundation strengthening might also provide benefit.

Another Published Application, No. 2003/0010426, of Lockwood, describes upgrading existing steel monopoles by bonding fiber reinforced polymer materials to existing steel member or component surfaces.

Another Published Application, No. 2003/0205021 of Ryan, describes applying an exo-skeleton of tubular steel rods and adjustable clamps directly in contact with the exterior of previously erected tapered wireless communication monopoles.

Another Published Application, No. 2003/0026923 of Al-Zoubi et al. describes a sleeve system for reinforcing self-standing monopoles at select, predetermined locations. At least one pair of complimentary non-slip Filler is inserted between the monopole and the sleeve.

Another Published Application, by Cash, No. US 2004/0148903 describes applying sleeves to a tower. There are two foundations, one for the tower and one for the sleeves.

Another Published Application, by Brunozzi et al., No. US 2002/0170261 describes use of sectional elongated tubes affixed to a tower by clamping collars.

Another Published Application, by Kopshever, Sr., No. US 2004/0020158 describes the use of collars to sandwich vertical bars to a tower.

Another Published Application, by Hill et al., No. US 2002/0194794 describes the use of sleeves which are secured to a pole to provide enhanced strength.

Another Published Application, by Lockwood et al., No. US 2004/0134161 describes affixing supports to towers by structural adhesive.

A patent to Damiano, U.S. Pat. No. 6,513,299 describes a sleeve secured to a pole by braces.

A patent to Ritz, U.S. Pat. No. 6,453,636 describes the use of sleeves, wherein a second load is attached to the sleeve.

A patent by Ryan, U.S. Pat. No. 6,694,698 describes use of adjustable mounting clamps to secure a plurality of exo-skeleton tubular steel rods to an existing tower.

A patent to Payne, U.S. Pat. No. 6,915,618 describes another reinforcing apparatus for tower monopoles.

Even in view of the known prior art, need remains for additional system and methodology for reinforcing existing monopoles.

DISCLOSURE OF THE INVENTION

The disclosed invention is a system for reinforcing a pole comprising a plurality of reinforcing rods or steel members (1) and a number of mounting brackets (2) located at predetermined locations along the length of the pole. At the ends there can be an elongated bracket, or the spacing between a plurality of mounting brackets can be shorter than is the spacing between centrally located mounting brackets. The purpose is to effect transfer of the total force in the reinforcing rod or members to said pole, rather than just the unit force per length that the typical intermediate mounting brackets would support, such that the composite structure functions as a single member. Said mounting brackets are preferably affixed to said pole using off-the-shelf steel bolts (Lindapter Hollo-Bolt) (3) designed to connect to hollow steel structures not accessible from the inside, or can be welded thereto. Said reinforcing rods or steel members (1) are preferably affixed to said mounting brackets (2) by "U" bolts.

The disclosed invention can be applied to poles which comprise:

- a substantially constant diameter over their entire length;
- a tapering diameter over their length, said diameter being smaller at the top; and
- a plurality of sections which are of a sequentially stepwise decreasing diameter as the length of said pole is transversed from the bottom thereof to the top, and in which there is present at the juncture between at least two of said sections a transition ring designed to allow the continuous force transfer in the reinforcement rods or members.

In the latter case, said transition ring is preferably of a substantially donut shape having holes present at different distances along each of at least two radial loci which are projected from a common center point, such that reinforcing rods or steel members (1) from one section project through holes at one distance along said radial loci, and reinforcing rods or steel members (1) from the section adjacent thereto project through holes at another distance along said radial loci.

The present invention can be considered as a method of increasing the strength of poles, (such as those which carry a number of communications antennas), by reinforcing the outside thereof using several reinforcing rods or steel members and a number of mounting brackets located at predetermined locations along the length of the pole. And at the ends of the reinforcing rods or members, the mounting brackets provide the means for transferring excess forces and stresses in the pole shaft to the reinforcing rods or steel members, thus providing additional reinforcement to offset any increase in the bending force of the monopole structure resisting the weight and wind resistance from one or more additional communications antennas.

Each mounting bracket comprises a standard steel member in the form of a standard steel angle or standard steel I-beam or wide flange or the like, cut to the required length and connected to the outside of pole structure. The reinforcing mounting brackets are connected to the outside surface of the pole shaft with the means of a patented off-the-shelf steel bolt (Lindapter Hollo-Bolt) which is designed to connect to hollow steel structures not accessible from the inside. As mentioned, the mounting brackets can also be welded to the pole shaft.

The plurality of reinforcement steel rods or the like are connected to mounting brackets with standard steel bolts.

Typical practice involves use of several reinforcing rods or steel members and a number of mounting brackets located at predetermined locations along the length of the pole, and at the ends of the reinforcing rods or members. The ends of the reinforcement rods or members are attached to the face of the pole shaft in a manner which transfers the total force in the reinforcing rod or members to the pole, and not just the unit force per length that the typical intermediate mounting brackets would support. It is the combination of said mounting brackets with the considerably stronger and longer mounting bracket used at the respective ends that make the pole and the reinforcing rods or members act and behave as one 100% composite manner, thus providing the means for transferring the excess forces and stresses in the pole shaft to the reinforcing rods or steel members thus providing the needed additional reinforcement to offset any increase in the bending force of the monopole structure resisting the weight and wind resistance from one or more additional communications antennas.

One end of the reinforcing rods or the like terminate at the base of the pole at the foundation and said reinforcing rods or the like are anchored to, and extended into the foundation by drilling a hole into the concrete and grouting using cement grout or epoxy.

Where one end of the reinforcing rods or the like terminates at the base of the pole, the pole base plate might have to be notched and reinforced with welded stiffeners to allow the reinforcement members to pass therethrough and anchor into the foundation.

The system of several reinforcing rods or steel members and a number of mounting brackets located at predetermined locations along the length of the pole can also be applied to poles that are made of tapered or non-tapered circular pipe sections attached together and referred to in the industry as pipe poles or stepped poles. The system can also be applied to the outside of a pipe pole or stepped pole structure where a transition ring is used to allow the continuous force transfer in the reinforcement rods or members. The number of transition rings used per pole is dependent on the number of joints or sections that make up a pipe pole or stepped pole structure.

A present invention method of reinforcing poles comprises the steps of:

a) providing a system for reinforcing towers as described above;

b) positioning a transition ring of a donut shape and having holes present at different distances, along each of at least two radial loci which are projected from a common center point, at the location of said juncture between at least two of said sections;

c) causing reinforcing rods or steel members (1) from one section project through holes at one distance along said radial loci, and reinforcing rods or steel members (1) from one the section adjacent thereto project through holes at another distance along said radial loci.

The disclosed invention will be beter understood by reference to the Detailed Disclosure Section in combination with the Drawings.

BRIEF DESCRIPTION OF THE DRAWINGS

FIG. 3 is a cross-sectional taken at through FIG. 1 at "a—a".

DETAILED DESCRIPTION

Figure 1:
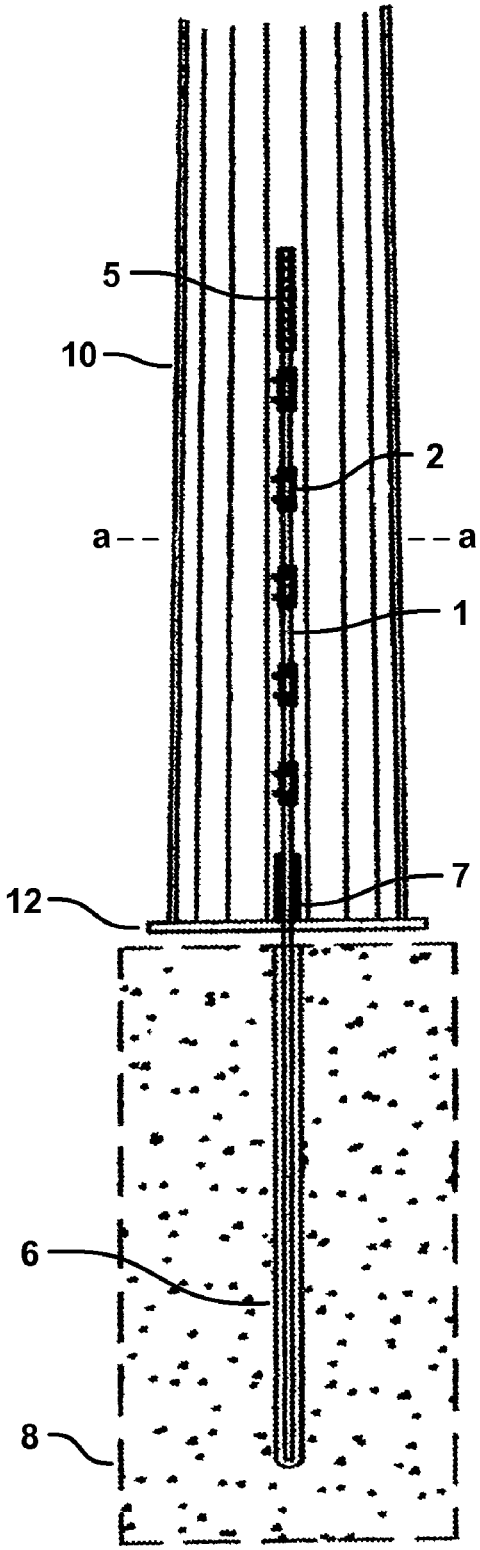
FIGS. 1 and 3 show several reinforcing rods or steel members (1) and a number of mounting brackets (2) located at predetermined locations along the length of the pole and at the respective ends of the reinforcing rods or members.

Turning now to the Drawings, there is demonstrated a system for reinforcement of poles on the outside thereof, said pole structure being of the sort suitable for carrying a number of communications antennas. FIG. 1 shows a reinforcing rod or steel member (1) and a number of mounting brackets (2) located at predetermined locations along the length of the pole (10), with the brackets at the ends of reinforcing rod or member being longer, or the spacing being a plurality of brackets being shorter at the respective ends of said reinforcing rod or member. Said shorter spacing between laterally located mounting brackets is determined to effect transfer of the total force in the reinforcing rod or members to said pole, rather than just the unit force per length that the typical intermediate mounting brackets supports. The result is that the composite structure functions as a single member. Each of said mounting brackets provides means for transferring excess forces and stresses in the pole shaft to the reinforcing rods or steel members thus providing the needed additional reinforcement to offset any increase in the bending force of the monopole structure to resist weight and wind effected forces resulting from communications antennas mounted on said pole.

Figure 2:
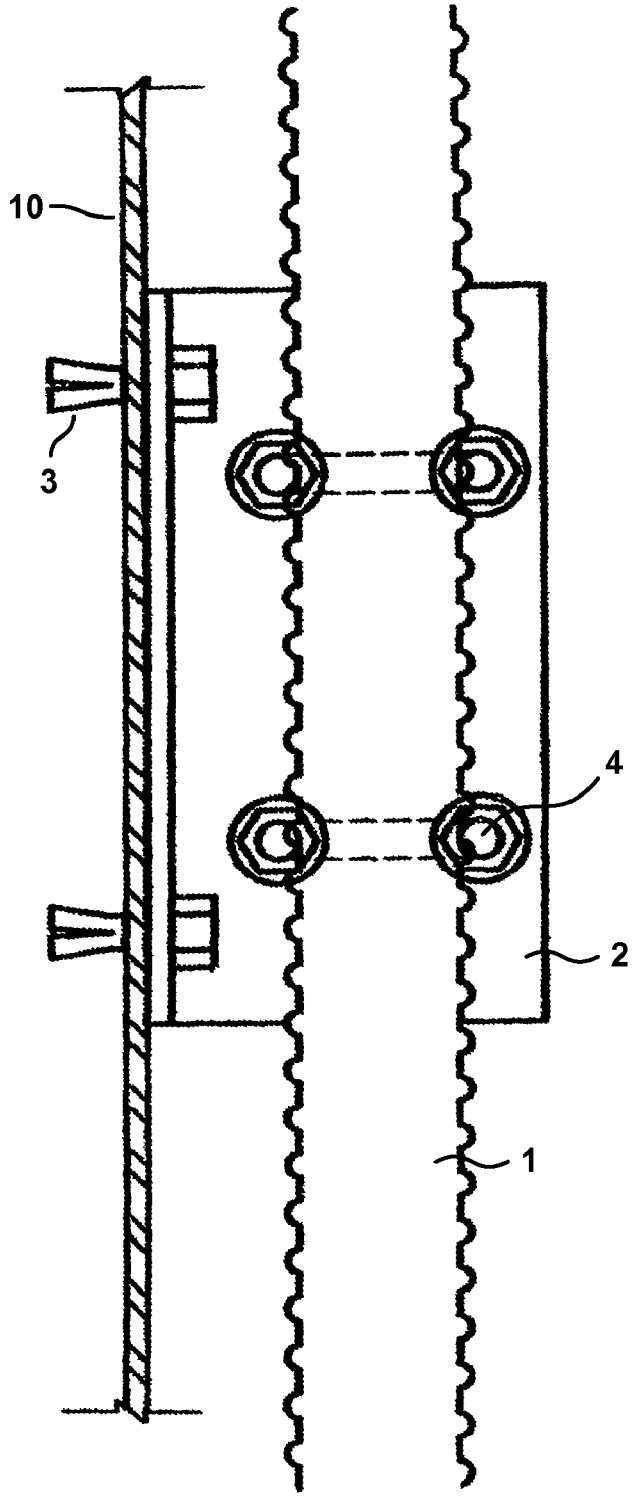
FIG. 2 demonstrates preferred means for affixing said mounting brackets (2) to said pole, and preferred "U" bracket means for affixing said reinforcing rods or steel members (1) to said mounting brackets (2).
Figure 3:
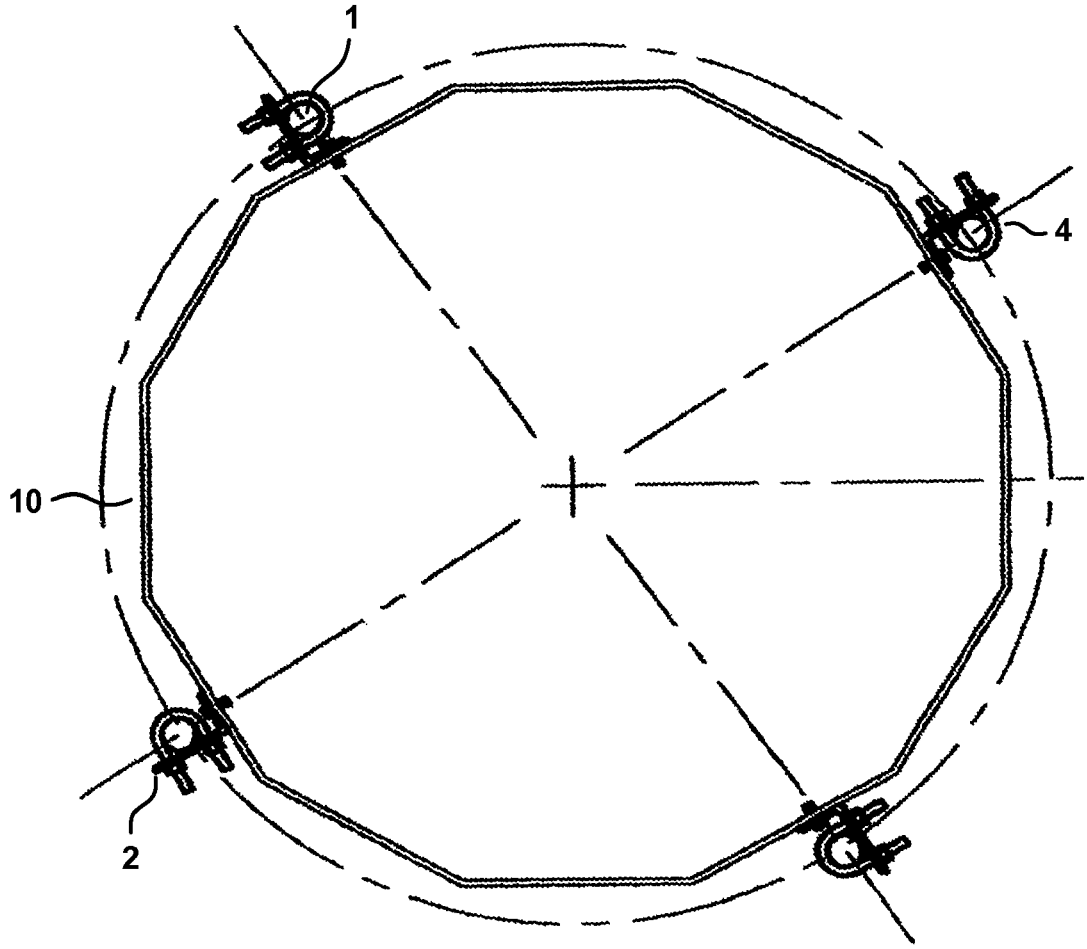

The reinforcement preferably provides that each mounting bracket (2) comprise a standard steel member in the form of a standard steel angle or standard steel I-beam or wide flange or the like, which is cut to the required length and connected to the outside of pole structure. Said reinforcement mounting brackets (2) are preferably connected to the outside surface of the pole shaft by being welded thereto, or by means of a off-the-shelf steel bolts (3), (eg. Lindapter Hollo-Bolts), which are designed to connect to hollow steel structures which not accessible from the inside. FIG. 2 demonstrates preferred means for affixing said mounting brackets (2) to said pole, and preferred "U" bolt (4) means for affixing said reinforcing rods or steel members (1) to said mounting brackets (2).

The disclosed invention provides that reinforcement, comprising a plurality of reinforcing rods or steel members (1) be applied via a number of mounting brackets (2) which are located at predetermined locations along the length of a pole, and that at the ends of the reinforcing rods or members, each of the reinforcement rods or members be attached to the face of the pole shaft in a way to transfer the total force in the reinforcing rod or members, and not just the unit force per length that the typical intermediate mounting brackets would support. It is the application of stronger and effectively longer mounting brackets at the respective ends (5) of rods (1) that make the pole and the reinforcing rods or members act and behave as one 100% composite manner, and thus provide the means for transferring the excess forces and stresses in the pole shaft to the reinforcing rods or steel members. Use of the present invention provides additional reinforcement which offsets increase in the bending force of the monopole structure resisting the weight of added communication antennas, and wind resistance presented by additional communications antennas.

It is noted that said several reinforcing rods or steel members (1) can terminate at the base of the pole and in the foundation (8). Said reinforcing rods or members are then anchored to, and/or extended into the foundation via a hole drilling into present concrete and grouting using cement grout and/or epoxy (6). It is noted that for the reinforcing rods or members to be anchored to and extended into the foundation, the pole base plate (12) has to be notched and reinforced with welded stiffeners (7) in order to allow the reinforcement members to pass through and anchor into the foundation.

Figure 4:
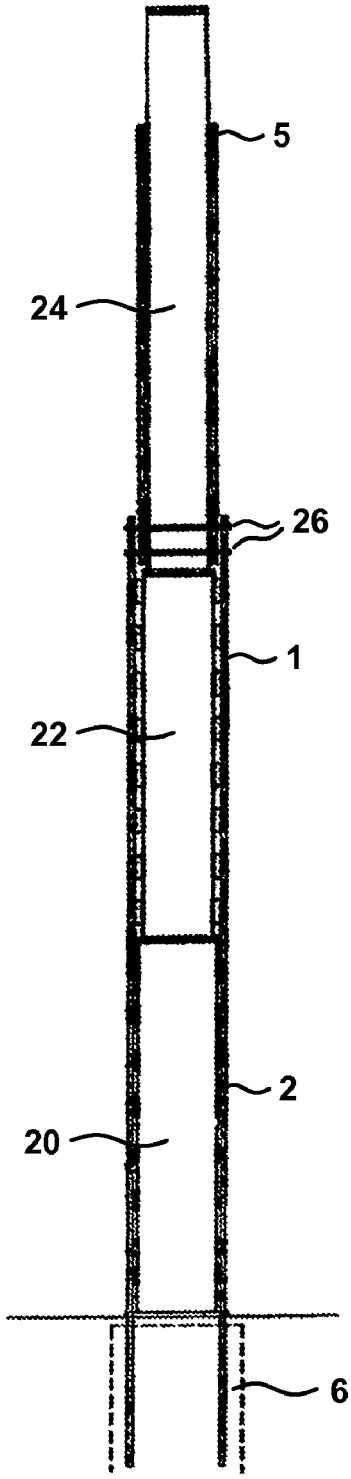
FIG. 4 shows a plurality of transition rings in place in a pole which comprises a plurality of sections which are of a sequentially stepwise decreasing diameter as the length of said pole is transversed from the bottom thereof to the top.

FIG. 4 shows a plurality of transition rings (26) in place in a pole which comprises a plurality of sections (20, 22, 24) which are of a sequentially stepwise decreasing diameter as the length of said pole is transversed from the bottom thereof to the top.

Figure 5:
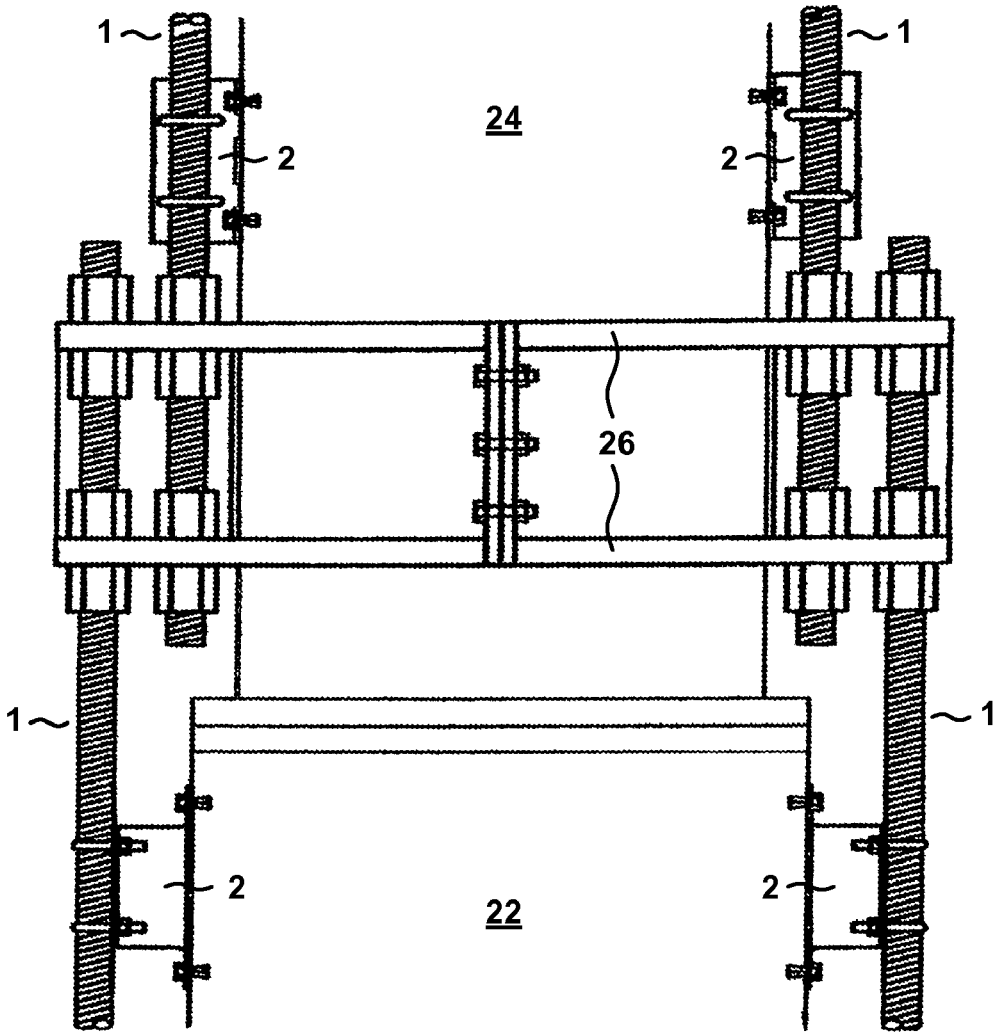
FIG. 5 provides more detail at the juncture between at least two of said sections and shows a transition ring designed to allow the continuous force transfer in the reinforcement rods or members.

FIG. 5 provides more detail at the juncture between at least two of said sections and shows a transition ring designed to allow the continuous force transfer in the reinforcement rods or members.

Figure 6:
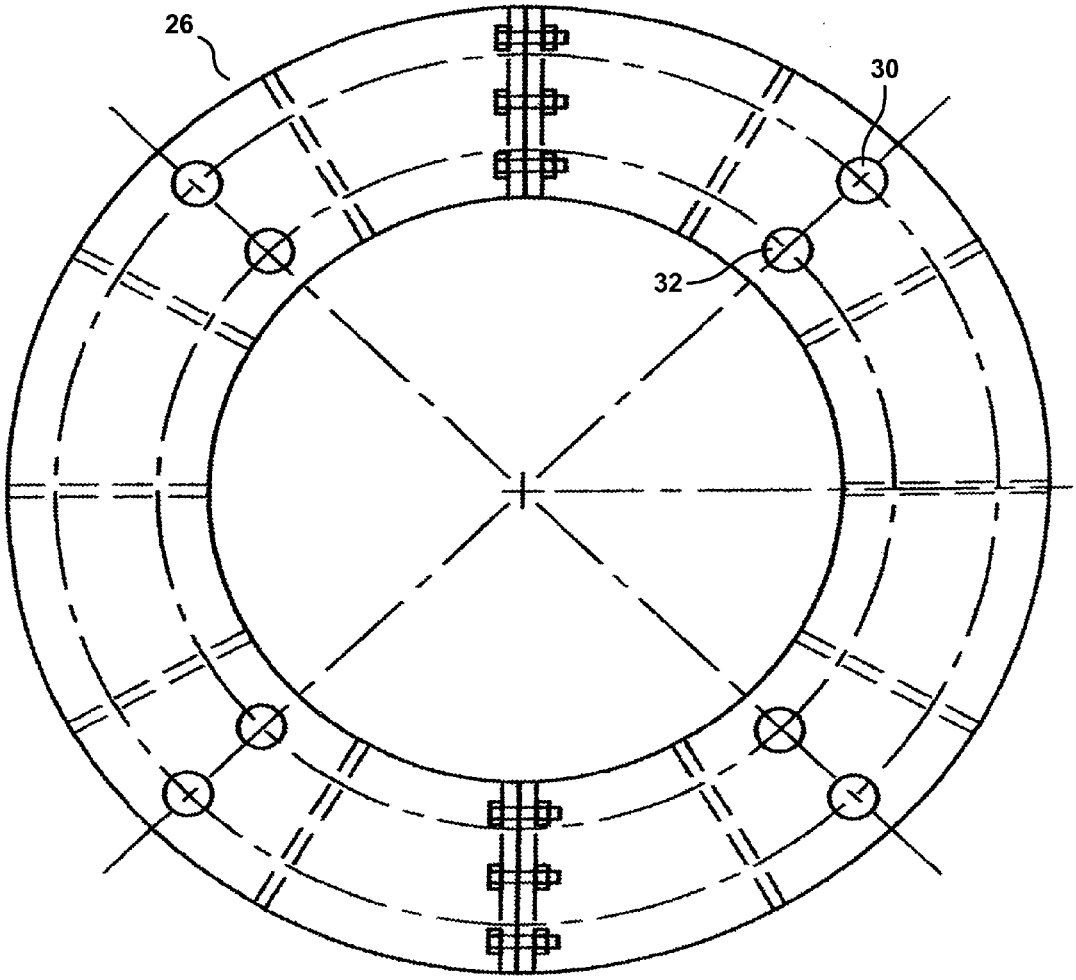
FIG. 6. shows a transition ring of a donut shape and having holes present at different distances, along each of at least two (eg. four shown), radial loci which are projected from a common center point, such that reinforcing rods or steel members (1) from one section project through holes at one distance along said radial loci, and reinforcing rods or steel members (1) from one the section adjacent thereto project through holes at another distance along said radial loci.

FIG. 6 shows a transition ring (26) of a donut shape and having holes (30, 32) present at different distances, along each of at least two (e.g., four shown), radial loci which are projected from a common center point, such that reinforcing rods or steel members (1) from one section project through holes at one distance along said radial loci, and reinforcing rods or steel members (1) from the section adjacent thereto project through holes at another distance along said radial loci.

It is to be appreciated that the reinforcement system and method described above can be applied to poles that are straight, tapered, made of a plurality of tapered (not typical) and/or non-tapered circular pipe sections attached together and referred to in the industry as pipe poles or stepped poles. Where a plurality of tapered and/or non-tapered circular pipe sections are present, the use of a transition ring (see FIGS. 5 & 6) which is designed to allow the continuous force transfer in the reinforcement rods or members (1) is utilized. The number of transition rings (see FIGS. 5 & 6) used per pole is, of course, dependent on the number of joints or sections that make up a pipe pole or stepped pole structure.

Having hereby disclosed the subject matter of the present invention, it should be obvious that many modifications, substitutions, and variations of the present invention are possible in view of the teachings. It is therefore to be understood that the invention may be practiced other than as specifically described, and should be limited in its breadth and scope only by the Claims.

The invention claimed is:

1. A method of reinforcing a pole, comprising the steps of:

a) providing a system for reinforcing a pole including a plurality of reinforcing rods or members and a number of mounting brackets including a first mounting bracket and a second mounting bracket located at predetermined locations along the length of the pole and attaching the plurality of reinforcing rods or members to the pole, wherein said first mounting bracket located at an end of one of the plurality of reinforcing rods or members is longer than said second mounting bracket centrally located along said reinforcing rod or member, wherein the pole comprises a plurality of sections which are of a sequentially stepwise decreasing diameter as the length of said pole is transversed from the bottom thereof to the top, and in which there is present at the juncture between at least two of said sections a transition ring to allow the continuous force transfer in the reinforcement rods or members;

b) positioning a transition ring of a donut shape and having holes present at different distances, along each of at least two radial loci which are projected from a common center point, at the location of said juncture between at least two of said sections and extending horizontally around the outside the pole at said juncture;

c) causing at least a first of said reinforcing rods or steel members from one section to project through a hole at one distance along said radial loci, and at least a second of said reinforcing rods or steel members from one section adjacent thereto to project through a hole at another distance along said radial loci.

2. A method for reinforcing a pole comprising:

attaching a plurality of reinforcing rods or members to the pole using a plurality of mounting brackets including a first mounting bracket and a second mounting bracket, including using said first mounting bracket which is longer than said second mounting bracket near an upper end of one of the plurality of reinforcing rods or members and using said second mounting bracket which is shorter than said first mounting bracket more centrally along the pole.

3. The method as recited in claim 2, further comprising anchoring the plurality of reinforcing rods or members in a foundation of the pole.

4. The method as recited in claim 3, wherein said anchoring comprises drilling into concrete of the foundation and grouting using cement grout and/or epoxy.

5. The method as recited in claim 3, further comprising notching a pole base plate to allow the plurality of reinforcing rods or members to extend into the foundation.

6. A system for reinforcing a pole comprising a plurality of reinforcing rods or members and a plurality of mounting brackets including a first mounting bracket and a second mounting bracket located at predetermined locations along the length of the pole and attaching the plurality of reinforcing rods or members to the pole, wherein said first mounting bracket located at an end of a reinforcing rod or member is longer than said second mounting bracket located centrally along the reinforcing rod or member, and said first mounting bracket and said second mounting brackets effect transfer of the total force in the reinforcing rod or members to said pole.

7. A system as in claim 6, wherein said first mounting bracket and said second mounting bracket are affixed to said pole using bolts.

8. A system as in claim 7, wherein the pole comprises a plurality of sections which are of a sequentially stepwise decreasing diameter as the length of said pole is transversed from its bottom thereof to its top, and in which there is present at the juncture between at least two of said sections a transition ring to allow the continuous force transfer in the reinforcement rods or members.

9. A system as in claim 8, wherein said transition ring is of a donut shape and has holes present at different distances, along each of at least two radial loci which are projected from a common center point, such that reinforcing rods or steel members from one section project through holes at one distance along said radial loci, and reinforcing rods or steel members from one the section adjacent thereto project through holes at another distance along said radial loci.

10. A system as in claim 9, wherein the reinforcing rod or members are embedded in concrete at lower extents thereof.

11. The system as recited in claim 9, wherein the transition ring comprises a top portion and a bottom portion, wherein the top portion and the bottom portion are spaced apart from each other.

12. The system as recited in claim 11, wherein the holes of the transition ring are provided in an identical pattern in both the top portion and the bottom portion of the transition ring.

13. The system as recited in claim 9, wherein the transition ring comprises a first lateral section on one side of the pole and a second lateral section on the other side of the pole, wherein the first lateral section and second lateral section are attached together.

14. A system as in claim 6, wherein said first mounting bracket and said second mounting bracket are affixed to said pole by welding.

15. A system as in claim 6, wherein said reinforcing rods or members are affixed to said first mounting bracket and said second mounting bracket by "U" bolts.

16. A system as in claim 6, wherein the pole comprises a substantially constant diameter over its entire length.

17. A system as in claim 6, wherein the pole comprises a tapering diameter over its length, said diameter being smaller at its top.

18. A system as in claim 6, wherein the reinforcing rod or members are embedded in concrete at lower extents thereof.

19. A reinforced pole apparatus, comprising:

a pole;

a plurality of reinforcing rods or members running substantially parallel to the pole and having upper ends;

a first plurality of brackets attached to the pole and attached to the plurality of reinforcing rods or members near the upper ends thereof; and a second plurality of brackets attached to the pole and attached to the plurality of reinforcing rods or members below the first plurality of brackets, wherein the brackets of the first plurality of brackets are longer than the brackets of the second plurality of brackets.

20. A reinforced pole apparatus, comprising:

a pole;

a foundation upon which the pole is erected;

a plurality of reinforcing rods or members anchored in the foundation and running substantially parallel to the pole above the foundation;

a first plurality of brackets attached to the plurality of reinforcing rods or members near upper ends thereof and attached to the pole; and a second plurality of brackets attached to the plurality of reinforcing rods or members below the first plurality of brackets and attached to the pole, wherein the brackets of the first plurality of brackets are longer than the brackets of the second plurality of brackets.

* * * * *